US006457541B1

(12) United States Patent
Schoeffler

(10) Patent No.: US 6,457,541 B1
(45) Date of Patent: Oct. 1, 2002

(54) SURFACE CONTROLLED BY-PASS VALVE

(76) Inventor: William N. Schoeffler, 214 Carmel Dr., Lafayette, LA (US) 70501

( * ) Notice: Subject to any disclaimer, the term of this patent is extended or adjusted under 35 U.S.C. 154(b) by 0 days.

(21) Appl. No.: 09/687,771

(22) Filed: Oct. 14, 2000

(51) Int. Cl.[7] ..... E21B 34/06
(52) U.S. Cl. ..... 175/317; 166/319; 175/324
(58) Field of Search ..... 175/317, 324; 166/319

(56) References Cited

U.S. PATENT DOCUMENTS 3,804,186 A 4/1974 Schoeffler
3,967,680 A * 7/1976 Jeter ..... 166/250
4,470,464 A * 9/1984 Baldenko et al. ..... 166/325
4,519,574 A * 5/1985 Roper ..... 251/31
4,615,399 A 10/1986 Schoeffler
4,817,739 A * 4/1989 Jeter ..... 175/38
5,020,609 A * 6/1991 Jeter ..... 175/48
5,443,128 A * 8/1995 Amaudric du Chaffaut ... 175/25
6,293,342 B1 * 9/2001 McGarian ..... 166/317

* cited by examiner

*Primary Examiner*—Hoang Dang
(74) *Attorney, Agent, or Firm*—John D. Jeter

(57) ABSTRACT

The diverter valve is carried in a housing that serves as a length of drill string. A selector valve is actuated by selective mud flow control signals from the surface and can close to build internal pressure to move a poppet to open a by-pass channel. Positive resilient seals are carried inside a protective sleeve until the principal openings are closed, then the seal is deployed to stop leakage.

11 Claims, 2 Drawing Sheets

SURFACE CONTROLLED BY-PASS VALVE

This invention pertains to a tool for use as a length element of a pipe string in a well bore to respond to signals from the surface to redirect the flow route of fluid pumped down the pipe string bore.

BACKGROUND

In many operations involving pipe strings in well bores it is desirable to actuate valves down hole to alter the route of fluid flowing down the pipe string bore. In the past that has been done by various methods including balls and spears dropped down the pipe string bore. In some cases wire lines were run down the pipe string bore to actuate the control or to recover items already dropped down the bore. When valves are used down hole to control moving fluid it is prudent to avoid throttling of flow by valve elements depended upon for positive sealing against leakage. To seal drilling mud, elastomer seal elements are considered essential. If the elastomer is used to throttle fluid flow while closing, the abrasives present often damage the seal surfaces.

SUMMARY OF INVENTION

In a housing that serves as a length of the pipe string, a selector valve that responds to fluid flow rate manipulations at the surface changes the resistance to the flow of the fluid to cause a piston to move. The moving piston actuates a valve that closes one route and opens another. The preferred embodiment is actuated to close the flow route to the downwardly continuing pipe string and to open a fluid by-pass route through the wall of the pipe string. The piston is spring biased to a starting position to reverse the procedure.

The selector valve has a poppet that is spring biased against the flow of fluid and is moved against the spring by entrainment of the poppet with the flow. It moves axially in response to fluid flow rate changes. The selector valve movement is limited by a cam operating in a serpentine groove that progresses about a periphery. The groove allows the poppet to travel more axially on one excursion than it allows on the next. The poppet can close the valve on one excursion and cannot close it on the next. On the surface, the operator normally stops the mud flow and restarts it to cause the selector valve to make an axial excursion. If the tool is not actuated on that excursion, it will be actuated the next time the flow Is stopped and restarted. Therefore the driller has control of the down hole tool.

The selector valve is carried by the actuator piston. When the selector valve is closed, the piston moves In the direction of flow and operates a slide valve in the process. The slide valve opens transverse holes through the wall of the housing. That permits restricted flow to the well bore. The restriction to flow is enough to maintain enough pressure to keep the actuator piston moved against it's return spring to prevent valve chatter. The opening action first moves elastomer seals into a sleeve bore then moves the sleeve as a slide valve element to open ports covered by the sleeve. Closing action first moves the sleeve to throttle, and essentially stop the by-pass fluid flow, then moves the elastomer seals into position to serve as a positive closure between sleeve and mating bore.

A salient feature of the slide valve is the ability to positively seal the by-pass route without moving flexible seals over ports. The slide valve is a sleeve that carries the flexible seals over the ports. After the ports are closed by the sleeve, the flexible, positive, seals are moved to seal the narrow opening between the sleeve and it's mating bore. Friction of the flexible seals within the sleeve causes the sleeve to move with the seals until the sleeve is stopped by positive abutments. A detent arrangement prevents the sleeve from moving during opening of the ports until the seals are within the sleeve bore. No detent is needed with the usual seals to prevent the seals from moving out of the sleeve bore before the sleeve has reached it's closing travel limit. If seals become available that slide easily within the sleeve bore, a detent arrangement can be provided between sleeve and piston to hold the sleeve in position to protect flexible seals until the sleeve is forced to move relative to the piston by abutments on the housing.

These and other objects, advantages, and features of this invention will be apparent to those skilled in the art from a consideration of this specification, including the attached claims and appended drawings.

DETAILED DESCRIPTION OF DRAWINGS

Figure 1:
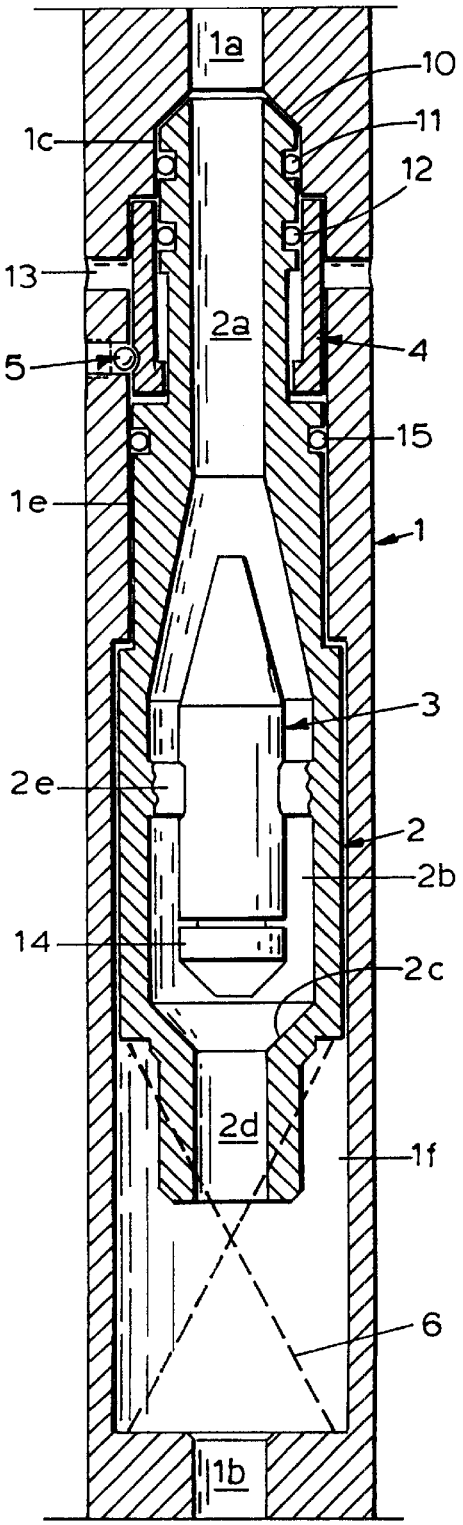
FIG. 1 is a side view, mostly cut away, of the preferred embodiment.

In the drawings, some details of construction that are well established in the art, and having no bearing upon points of novelty, are omitted in the interest of clarity of descriptive matter. Such details may include weld lines, threaded junctures, threaded fasteners, pins, and the like.

Figure 2:
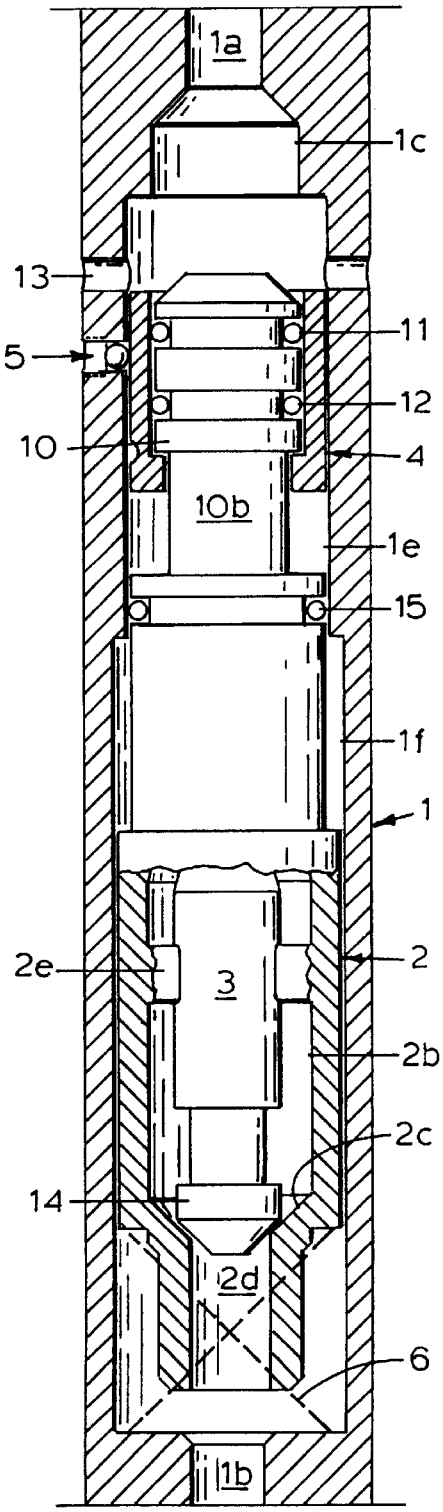
FIG. 2 is a side view, mostly cut away, comparable to FIG. 1 but actuated.

In FIGS. 1 and 2 housing 1 is usable as a length element of a drill string, with connections at each end (not shown) for attachment to a continuing drill string. Drilling fluid can flow into bore 1*a* from the upwardly continuing drill string, along bore 2*a*, along annular channel 2*b*, out bore 2*d* into opening 1*f* and out bore 1*b* to the bore of the pipe string below. If the by-pass is actuated, valve sleeve 4 moves down to uncover ports 13, and fluid flows directly to the well annulus. To move the sleeve down, selector valve 3 is actuated to drop poppet 14 to surface 2*c* to close bore 2*d*. Until the ports 13 are open, the pressure available at bore 1*a* acts upon piston 2 to move it down.

Slide valve sleeve 4 is delayed by detents 5 until the seals 11 are pulled into the sleeve bore as shown in FIG. 2. This avoids moving seals over open ports. The detent is, preferably, a purchase package of threaded body, ball, and spring. The detent ball is accepted by a mating pocket or ring on the sleeve.

When the slide valve (sleeve 4) is down, upward movement of the piston 2 (initiated by opening the selector valve by lifting poppet 14) moves the sleeve 4 upward due to friction drag of seals on the sleeve bore. The slide valve closes ports 13 to significant flow until seals 11 pass the narrow gap between the end of the sleeve and it's mating bore. Poppet 14 will not move upward until the drilling fluid flow is reduced to a very low amount. The poppet does move upward while there is some flow to prevent back flow of well fluid through ports 13.

It should be noted that the preferred configuration does not require positive seals on the selector valve element 14 and surface 2*c*. If it should be needed, the concept embraces the ability to put the slide valve arrangement shown on the upper end in the selector valve position as well.

Figure 3:
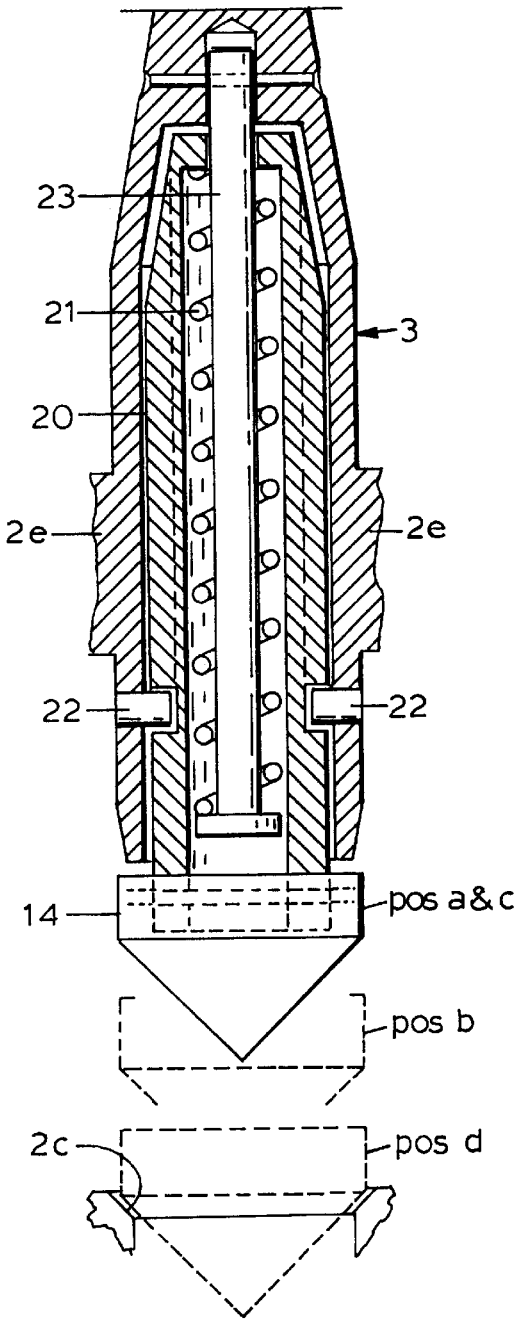
FIG. 3 is a side view, rather enlarged, mostly cut away of part of the apparatus of FIGS. 1 and 2.

In FIG. 3 the preferred selector valve 3 is shown in detail. This valve is suspended in channel 2*b* by legs, or spiders, 2*e* and the outside is swept by fluid moving downward through the piston. The fluid flow tends to entrain poppet 14 and move it downward, compressing spring 21. Cams 22 are secured to the body and engage a serpentine groove in carrier 20. Poppet 14 moves down and up when fluid flow down the pipe string is increased, then decreased. Spring 21 is attached to the body, for compressing action, by way of arbor 23.

Figure 4:
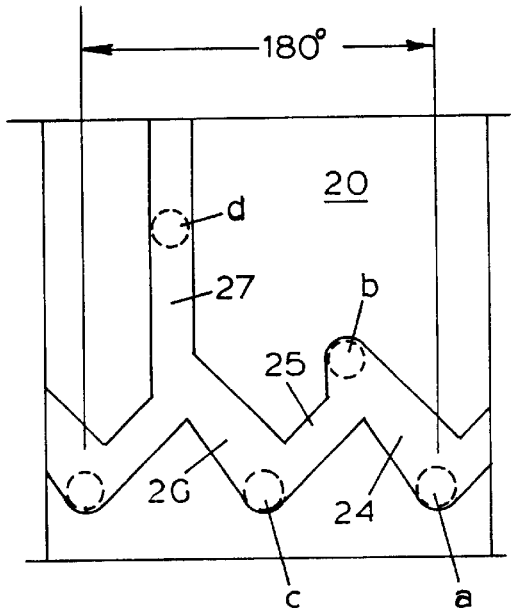
FIG. 4 is a development of the peripheral surface of the walk around features of the apparatus of FIG. 3.

In FIG. 4, half the peripheral surface of the carrier 20 is developed. The serpentine groove comprises tracts 24 through 27. Keep in mind that the pin 22 is attached to the body and does not move. The pin moves relative to the carrier and is shown progressing along the groove. Tracks 25 are all alike. Tracts 24 and 26 would be alike, but track 27 extends out the top of the carrier to aid assembly. That extension also allows the poppet to move to close the channel 2*d*. Positions a through d are shown. Positions a and c are axially equivalent and represent the no flow position. When fluid flow moves poppet 14 downward, the pin advances from position a to position b where it is stopped short of closing the channel 2*d*. The tool is not activated. When the fluid flow is stopped and restarted the pin moves first to position c, then to position d. In position d, the poppet closes the channel 2*d* and the piston 2 moves downward to activate the by-pass valve.

If need arises, any number of positions b can separate tracks 27. Similarly, any number of tracks 27 can separate positions b.

Figure 5:
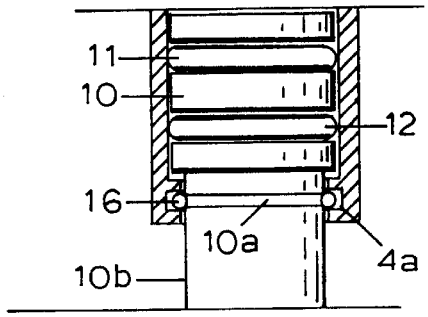
FIG. 5 is a fragmented side view of an alternate feature of the apparatus of FIGS. 1 and 2.

FIG. 5 shows an alternate movement control means for sleeve 4 relative to seal carrier piston 10. The seals 11, 12, and 15 are shown as O rings and may be considered symbolic. Different seals are used for different applications. The seals commonly have enough friction to move sleeve 4 unless it is restrained by external means. On the down stroke, detent 5 holds the sleeve until the seals are pulled within it's bore. If the seals selected have rather low friction, spring ring 16, radially movable in groove 4*a*, is used to engage groove 10*a* until it is forced out of the groove by the sleeve when it engages an abutment on the housing.

The apparatus of this invention is shown as a by-pass control because that is it's most immediate need. That use is not to be construed as a limitation. The valve, addresses a universal problem in the slide valve area. Flexible seals are moved across large openings by moving them when protected by a sleeve that operates to reduce flow to leakage before the flexible seals are introduced to the closure to be sealed after the slide valve is used to control flow.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A flow diverter apparatus housed in a length element of pipe string for use in wells, with a diverter valve controllable from the earth surface and situated to change the path of a fluid flow moving from an upwardly continuing pipe string to selected flow paths within the length element, the apparatus comprising:

a) a housing arranged to function as a length element of a pipe string, with a fluid channel extending longitudinally therethrough, and a general central opening;

b) a selector valve situated in said housing to variably resist the flow of fluid in said fluid channel to change the pressure drop in said channel in response to signals generated at the surface;

c) a piston situated in said opening for movement therein between first and second positions in response to said changes in said pressure drop;

d) a diverter valve, actuated by movement of said piston, to change the flow path of said fluid; and e) a biasing spring arranged to move said piston from a position to which said piston is moved when said pressure drop is increased.

2. The apparatus of claim 1 wherein said diverter valve comprises both resilient and non-resilient elements so arranged that, when reducing said flow, said diverter valve actuation comprises movement of the non-resilient element to reduce the flow and subsequent movement of the resilient element to seal the path being closed.

3. The apparatus of claim 2 wherein said selector valve comprises an axially sliding tubular element that carries said resilient sealing means in its bore until said flow is reduced.

4. The apparatus of claim 3 wherein said tubular element, when reducing said flow, leaves a peripheral closure between said axially sliding tubular element and said housing, said peripheral closure positively sealed by said resilient sealing element.

5. The apparatus of claim 1 wherein said selector valve responds to selected changes in flow rate of said fluid to change the state of said diverter valve, said states being open or closed.

6. A diverter valve apparatus for use in well bore activities, the apparatus comprising:

a) a housing arranged to function as a length element of a pipe string, with a first fluid channel extending longitudinally therethrough, and a generally central opening;

b) a tubular piston situated in said opening for axial movement therein, with a second fluid channel extending axially therethrough as part of said first channel;

c) a selector valve, carried by said piston, with a valve element situated to open or close said second channel in response to signals from the surface;

d) a by-pass flow path from said first channel through the wall of said housing;

e) a diverter valve, actuated by movement of said piston to open and close said by-pass flow path; and f) a biasing spring arranged to move said piston from a position to which said piston is moved when said second channel is closed.

7. The apparatus of claim 6 wherein said signals from the surface comprise change in the rate of flow of said fluid.

8. The apparatus of claim 6 wherein said diverter valve comprises both resilient and non-resilient elements so arranged that, when reducing said flow, said diverter valve actuation comprises movement of the non-resilient element to reduce flow and movement of the resilient element to seal the path being closed.

9. The apparatus of claim 8 wherein said selector valve comprises an axially sliding tubular element that cooperates with a flow channel to reduce said flow when closing and carries said resilient element in its bore until said flow is reduced.

10. The apparatus of claim 8 wherein said non-resilient element, when reducing said flow, leaves a peripheral closure between said non-resilient element and said housing, said peripheral closure positively sealed by said resilient element.

11. The apparatus of claim 8 wherein said selector valve responds to selected changes in flow rate of drilling fluid to change the state of said diverter valve, said states being open or closed.

* * * * *